US007681543B2

(12) United States Patent
Shin et al.

(10) Patent No.: US 7,681,543 B2
(45) Date of Patent: Mar. 23, 2010

(54) TAPPET APPARATUS

(75) Inventors: Ki Uk Shin, Hwaseong (KR); Jin Kook Kong, Suwon (KR); Won Geun Lee, Seongnam (KR); Kiyoung Kwon, Seoul (KR)

(73) Assignee: Hyundai Motor Company, Seoul (KR)

( * ) Notice: Subject to any disclaimer, the term of this patent is extended or adjusted under 35 U.S.C. 154(b) by 133 days.

(21) Appl. No.: 11/953,373

(22) Filed: Dec. 10, 2007

(65) Prior Publication Data

US 2009/0090317 A1 Apr. 9, 2009

(30) Foreign Application Priority Data

Oct. 5, 2007 (KR) ..... 10-2007-0100310

(51) Int. Cl.
*F01L 1/14* (2006.01)

(52) U.S. Cl. ..... 123/90.48; 123/90.52

(58) Field of Classification Search ..... 123/90.52, 123/90.48, 90.16

See application file for complete search history.

(56) References Cited

U.S. PATENT DOCUMENTS 6,076,491 A * 6/2000 Allen ..... 123/90.16

* cited by examiner

*Primary Examiner*—Zelalem Eshete
(74) *Attorney, Agent, or Firm*—Morgan, Lewis & Bockius LLP

(57) ABSTRACT

A tappet apparatus cooperates with a valve and a cam. The apparatus includes a case to reciprocate motion of the cam; and a locking unit in the ease, movable between an activated position at which the valve reciprocates motion of the case, and a deactivated position at which the valve is stationary regardless of the motion of the case. The locking unit may include first and second passages in the case; a pin, movable between a first and a second position within the first passage; and a column in the second passage. The pin may be situated in the column when the pin is in the second position. The activated position may be defined by the pin being in the first position, and the deactivated position may be defined by the pin being in the second position.

5 Claims, 4 Drawing Sheets

TAPPET APPARATUS

CROSS-REFERENCE TO RELATED APPLICATION

This application claims priority to, and the benefit of, Korean Patent Application No. 10-2007-0100310, filed in the Korean Intellectual Property Office on Oct. 5, 2007, the entire contents of which are incorporated herein by reference.

BACKGROUND OF THE INVENTION (a) Field of the Invention

The present invention relates to a tappet apparatus with a cylinder deactivation function.

(b) Description of the Related Art

In typical light load driving, the driver uses only around 30% of an engine's maximum power. In these conditions, the throttle valve is nearly closed, and the engine needs to work to draw in air. This causes cylinder pressure to be very low, leading to low fuel efficiency.

Cylinder deactivation is thus used at light load so that the throttle valve can be opened further to provide the same power output. This increases pressure in each cylinder. Cylinder deactivation is achieved by keeping the intake or exhaust valves closed for a particular cylinder.

A typical cylinder deactivation apparatus includes a three-part variable tappet, a lock pin, and a double cam. The three parts of the tappet can be separated from one another and cooperate with the double cam to deactivate a cylinder.

The double cam and variable tappet are costly to manufacture and complicated to assemble.

The above information disclosed in this Background section is only for enhancement of understanding of the background of the invention and therefore it may contain information that does not form the prior art that is already known in this country to a person of ordinary skill in the art.

SUMMARY OF THE INVENTION

A tappet apparatus cooperates with a valve and a cam. The apparatus includes a case to reciprocate motion of the cam and a locking unit in the case, movable between an activated position at which the valve reciprocates motion of the case, and a deactivated position at which the valve is stationary regardless of the motion of the case.

The locking unit may include first and second passages in the case; a pin, movable between a first and a second position within the first passage; and a column in the second passage. The pin may be situated in the column when the pin is in the second position. The activated position may be defined by the pin being in the first position, and the deactivated position may be defined by the pin being in the second position.

A hydraulic line may be provided in the ease for supplying hydraulic pressure to move the pin between the first and second positions.

The pin may have an inclined portion to contact the column and bias the pin to the second position.

The apparatus may also include a cap for adjusting a gap of the valve.

An elastic member may be provided in the first passage, biasing the pin toward the first position.

DETAILED DESCRIPTION OF PREFERRED EMBODIMENTS

An exemplary embodiment the present invention will be described more fully hereinafter with reference to the accompanying drawings.

Figure 1:
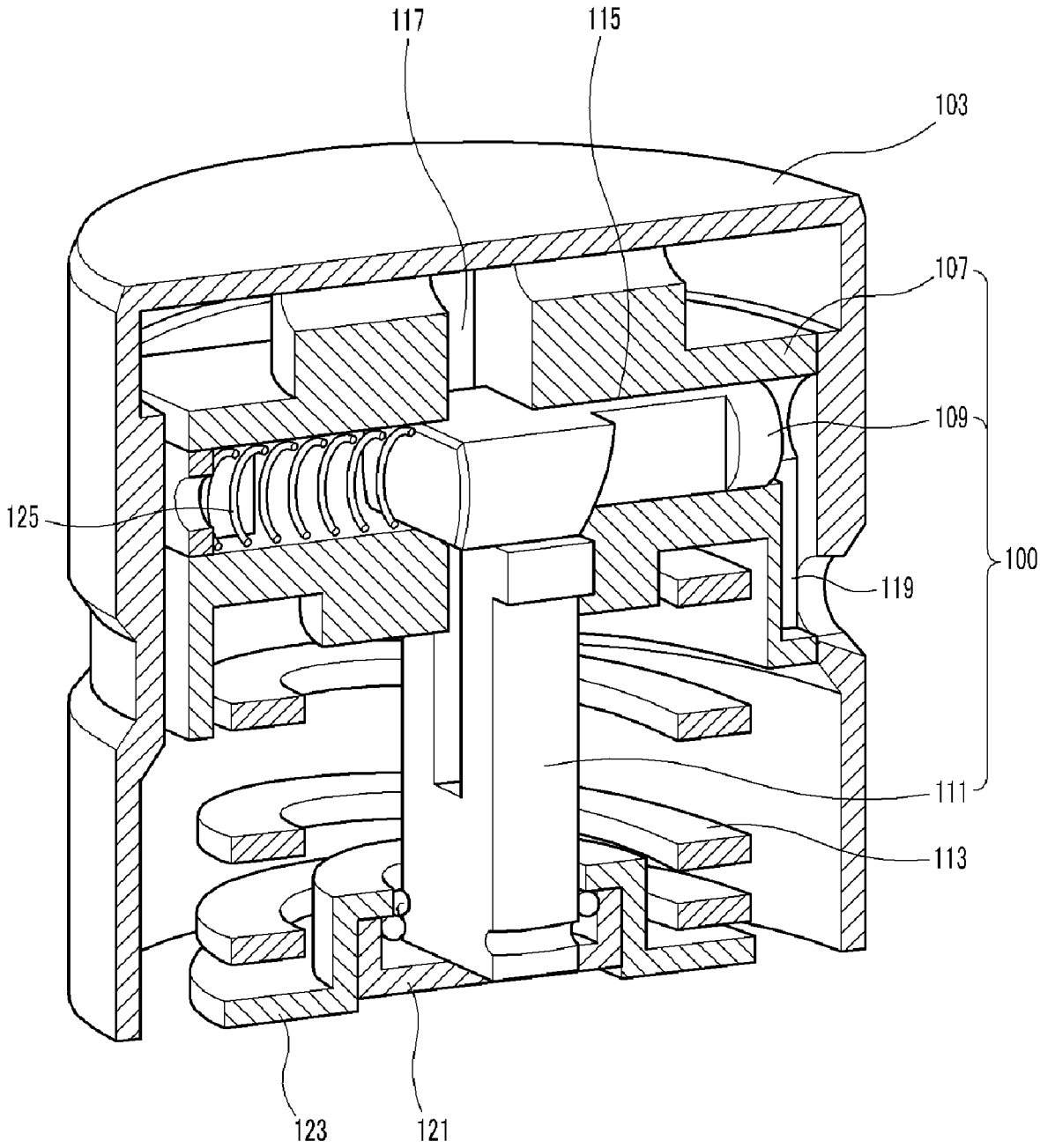
FIG. 1 is a cross-sectional view showing a tappet apparatus according to an exemplary embodiment of the present invention.
Figure 3:
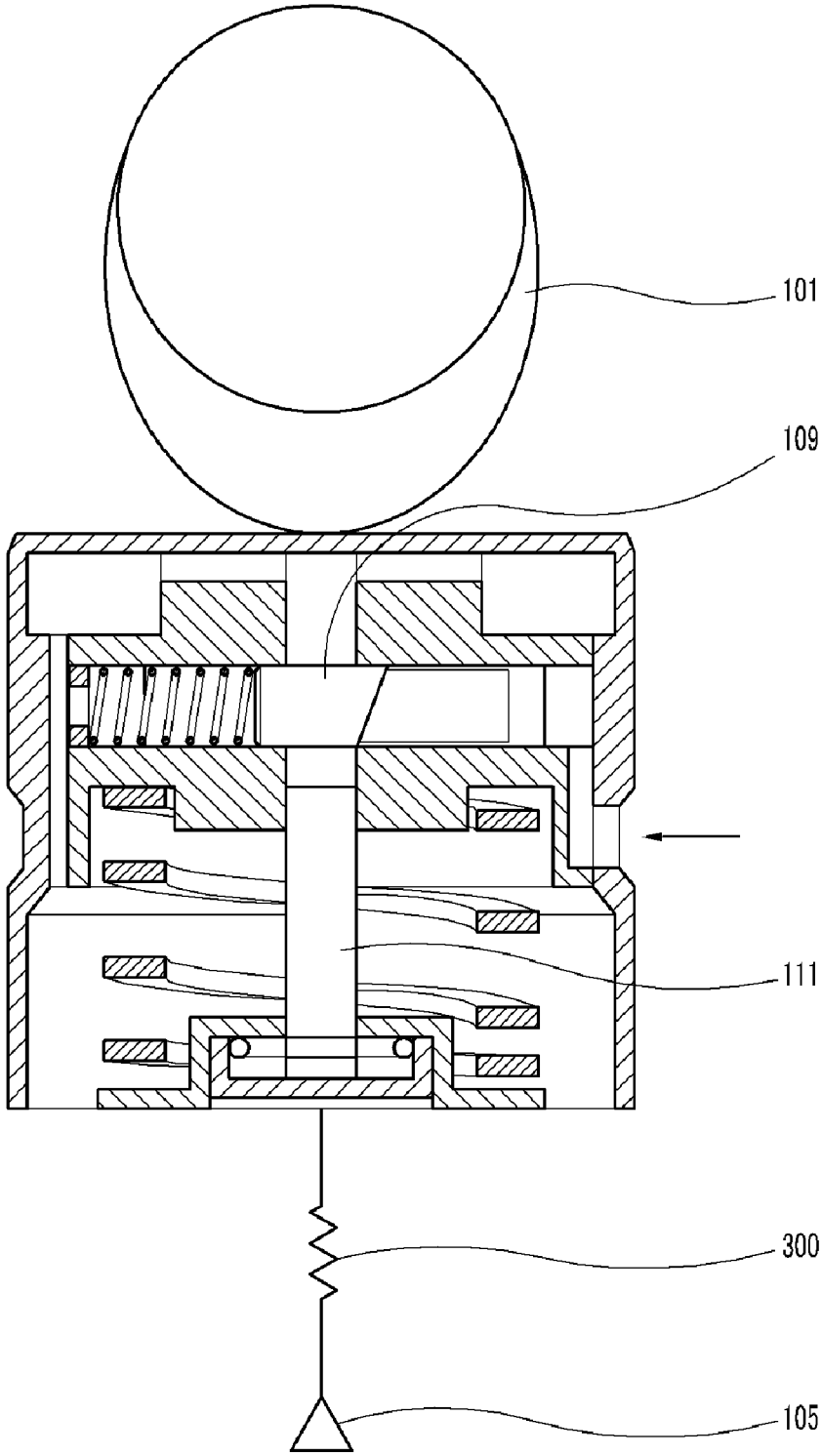
FIG. 3 and FIG. 4 illustrate the operation of the tappet of FIG. 1.
Figure 4:
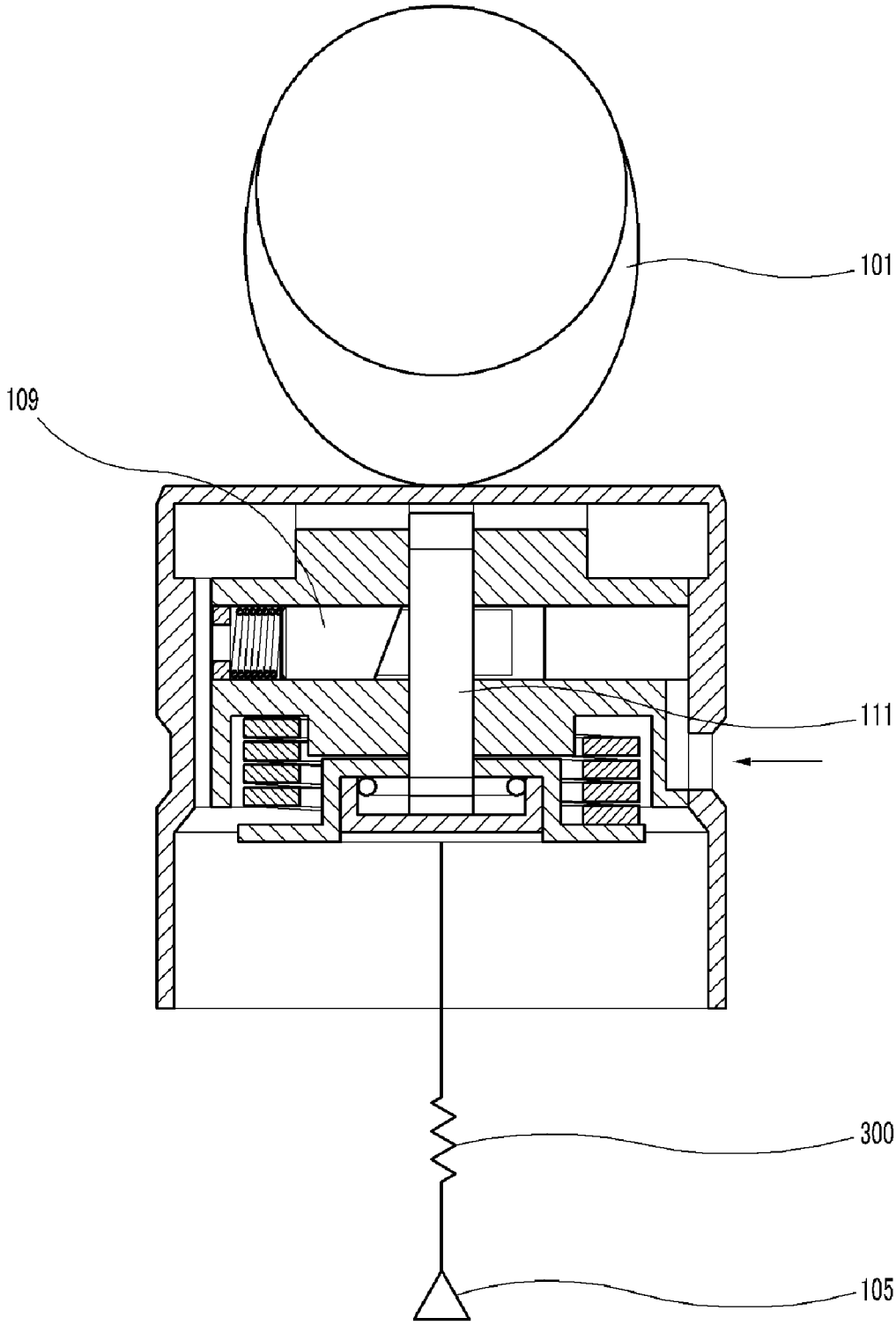

Referring to FIGS. 3-4, a tappet apparatus according to an exemplary embodiment of the present invention is used for opening and closing a valve 105 by rotation of a cam 101. Referring to FIG. 1, the apparatus includes a case 103, a locking unit 100, and a first elastic member 113.

The locking unit 100 includes a guide 107, a pin 109, and a column 111. The case 103 contacts the cam 101, and the locking unit 100 opens, closes, or deactivates the valve 105. The guide 107 is disposed in the case 103 and has passages 115, 117, and a hydraulic line 119 therein.

The pin 109 is disposed in the first passage 115, and moves according to hydraulic pressure in the passage. The column 111 selectively either reciprocates with the guide 107, acting as a single body, or is separated from the guide 107, depending on the position of the pin 109.

The first elastic member 113 for supplying restoring force to the locking unit 100 is disposed in the case 103.

Referring to FIG. 3, when the cam 101 pushes the case 103, the force is transmitted to the valve 105 through the guide 107, the pin 109, and the column 111.

The pin 109 is movable within the first passage 115, and the column 111 is movable within the second passage 117. Hydraulic pressure in the hydraulic line 119 moves the pin 109.

Referring to FIG. 3 and FIG. 4, when hydraulic pressure flows into the hydraulic line 119, the pin 109 moves left in the drawings.

Figure 2:
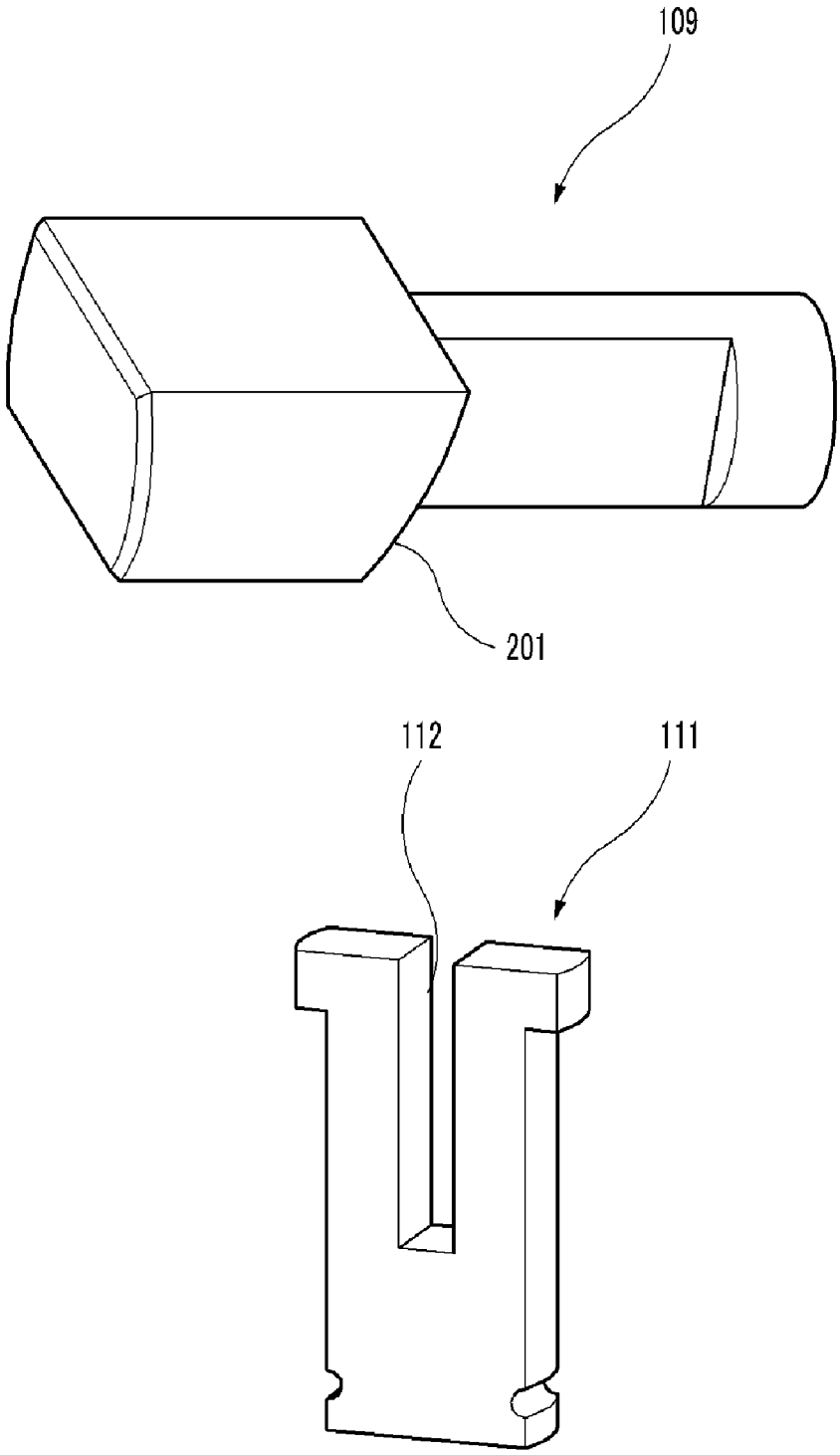
FIG. 2 is a perspective view of a pin and column of the tappet apparatus of FIG. 1.

As shown in FIGS. 2 and 4, when the cam 101 pushes the case 103 down, the pin 109 is pressed into a pin inserting portion 112 in the column 111. The column 111 does not move. Thus, the valve 105 is not pressed downward; i.e. it is deactivated.

The elastic force of the first elastic member 113 is smaller than that of a valve elastic member 300, ensuring that the valve 105 is not opened by the force of the first elastic member 113.

In an exemplary embodiment of the present invention, the pin 109 includes an inclined portion 201, which aids in the leftward motion of the pin when the inclined portion 201 contacts the column 111.

Referring back to FIG. 1, the apparatus further includes a second elastic member 125 in the passage 115 that biases the pin 109 to the right in the drawings, such that when the hydraulic pressure is released, the pin 109 returns to its original position, reactivating the valve 105.

The apparatus further includes a cap 121 for adjusting a gap of the valve 105 and a plate 123 disposed below the case 103 for supporting the first elastic member 113.

The tappet may be a mechanical lash adjuster type, so that a gap of the valve 105 can be adjusted by the cap 121.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A tappet apparatus configured to cooperate with a valve and a cam, the apparatus comprising:

a case configured to reciprocate motion of the cam; and a locking unit disposed in the case and movable between an activated position at which the valve reciprocates motion of the case, and a deactivated position at which the valve is substantially stationary regardless of the motion of the case;

wherein the locking unit comprises:

a first and a second passage in the case;

a pin that is movable within the first passage between a first and a second position; and a column disposed in the second passage and configured for the pin to be disposed therein when the pin is in the second position;

wherein the activated position is defined by the pin being in the first position, and the deactivated position is defined by the pin being in the second position.

2. The tappet apparatus of claim 1, further comprising a hydraulic line for supplying hydraulic pressure to move the pin between the first and second positions.

3. The tappet apparatus of claim 1, wherein the pin comprises an inclined portion configured to contact the column and bias the pin to the second position.

4. The tappet apparatus of claim 1, further comprising a cap for adjusting a gap of the valve.

5. The tappet apparatus of claim 1, further comprising an elastic member in the first passage, biasing the pin toward the first position.

* * * * *